United States Patent [19]

Goehler et al.

[11] 4,454,780

[45] Jun. 19, 1984

[54] VIBRATORY MECHANISM

[75] Inventors: Robert F. Goehler, Greencastle; Jeffrey L. Addleman, Chambersburg; Dana R. Rotz, Shippensburg, all of Pa.

[73] Assignee: Ingersoll-Rand Company, Woodcliff Lake, N.J.

[21] Appl. No.: 280,939

[22] Filed: Jul. 6, 1981

[51] Int. Cl.[3] ..... E01C 19/38; F16H 33/10

[52] U.S. Cl. ..... 74/87; 404/117

[58] Field of Search ..... 74/87, 61; 173/49; 404/117; 198/770; 366/128; 310/81; 206/367

[56] References Cited

U.S. PATENT DOCUMENTS

| | | | |
|---|---|---|---|
| 2,677,967 | 5/1954 | Galbraith | 74/87 |
| 2,937,537 | 5/1960 | Woll | 74/87 |
| 3,277,731 | 10/1966 | Pinson | 74/87 |
| 3,339,422 | 9/1967 | Petrin | 74/87 |
| 3,433,311 | 3/1969 | Lebelle | 74/61 |
| 3,590,702 | 7/1971 | Sechi | 404/117 |
| 3,736,066 | 5/1973 | Koontz | 404/117 |
| 4,108,009 | 8/1978 | Fuchigami | 74/61 |
| 4,152,943 | 5/1979 | Wall | 74/87 |
| 4,211,121 | 7/1980 | Brown | 74/87 |

FOREIGN PATENT DOCUMENTS

| | | | |
|---|---|---|---|
| 2409417 | 9/1975 | Fed. Rep. of Germany | 74/61 |
| 1336783 | 7/1963 | France | 404/117 |
| 7801656 | 9/1978 | Netherlands | 366/128 |

*Primary Examiner*—Thomas J. Holko
*Assistant Examiner*—Lloyd A. Gall
*Attorney, Agent, or Firm*—B. J. Murphy

[57] ABSTRACT

The mechanism, designed especially for use in an earth compacting drum, comprises a pair of concentrically-arranged, eccentrically-weighted elements, which are rotated in unison by means of a hydraulic motor. The mechanism is housed within an earth compacting drum, and the one eccentrically-weighted element is translatable, axially, and disengageable from a splined coupling, in order that it may be indexed to different rotary positions relative to the other eccentrically-weighted element. In this manner, vibratory amplitudes may be increased or decreased.

11 Claims, 2 Drawing Figures

VIBRATORY MECHANISM

This invention pertains to vibratory mechanisms, and the like, for use with earth compacting drums and, in particular, to such mechanisms having a plurality of commonlyrotated, eccentrically-weighted elements in which at least one thereof is adjustably indexable to selective positions. In such positions, its weight is additive to, or counteractive of, the eccentric weight of the or a companion, eccentrically-weighted element.

Mechanisms of this type are well known in the prior art, particularly from U.S. Pat. No. 3,590,702 issued to Peppino Sechi, on July 6, 1971, for Vibratory Roller, and from U.S. Pat. No. 4,152,943, issued on May 8, 1979, to Geoffrey F. Wall, for a Vibratory Mechanism.

The vibratory roller, or the vibratory mechanism therein, disclosed by patentee Sechi, is somewhat similar to Applicants' present invention, except that the Sechi mechanism requires an extraneous tool for adjustable indexing one of the weighted elements relative to the other. In the patent to Wall, separate eccentric weights are enclosed in end housings and are joined by means of a flexible, timing shaft-coupling arrangement. The instant invention is an improvement over both prior mechanisms in which the mechanism is fully self-contained, requiring no extraneous tool, needs no timing shaft or flexible coupling, and requires no independent housings for eccentric weights.

It is an object of this invention to set forth a vibratory mechanism, especially for use with an earth-compacting drum, comprising: a plurality of elongate elements having eccentrically-weighted, radially-disposed portions; means supporting said elements for rotation about a common axis, with said portions in a first positioning wherein said portions are in common radial alignment therebetween, and in a second positioning wherein said portions are in diverse, non-radially-aligned dispositions therebetween; and means coupled to said elements for rotating the latter, in unison, about said axis; wherein said supporting and rotating means comprise means for adjustably orienting one of said elements, relative to the other thereof, from one of said first and second positionings to the other thereof; and said orienting means comprises means for (a) moving said one element in a first axial direction, (b) rotatably indexing said one element from said one positioning to said other positioning, (c) moving said one element in a second, opposite axial direction, and (d) displaceably securing said one element in said other positioning.

Further objects of this invention as well as the novel features thereof will become more apparent by reference to the following description taken in conjunction with the accompanying figures, in which.

Figure 1:
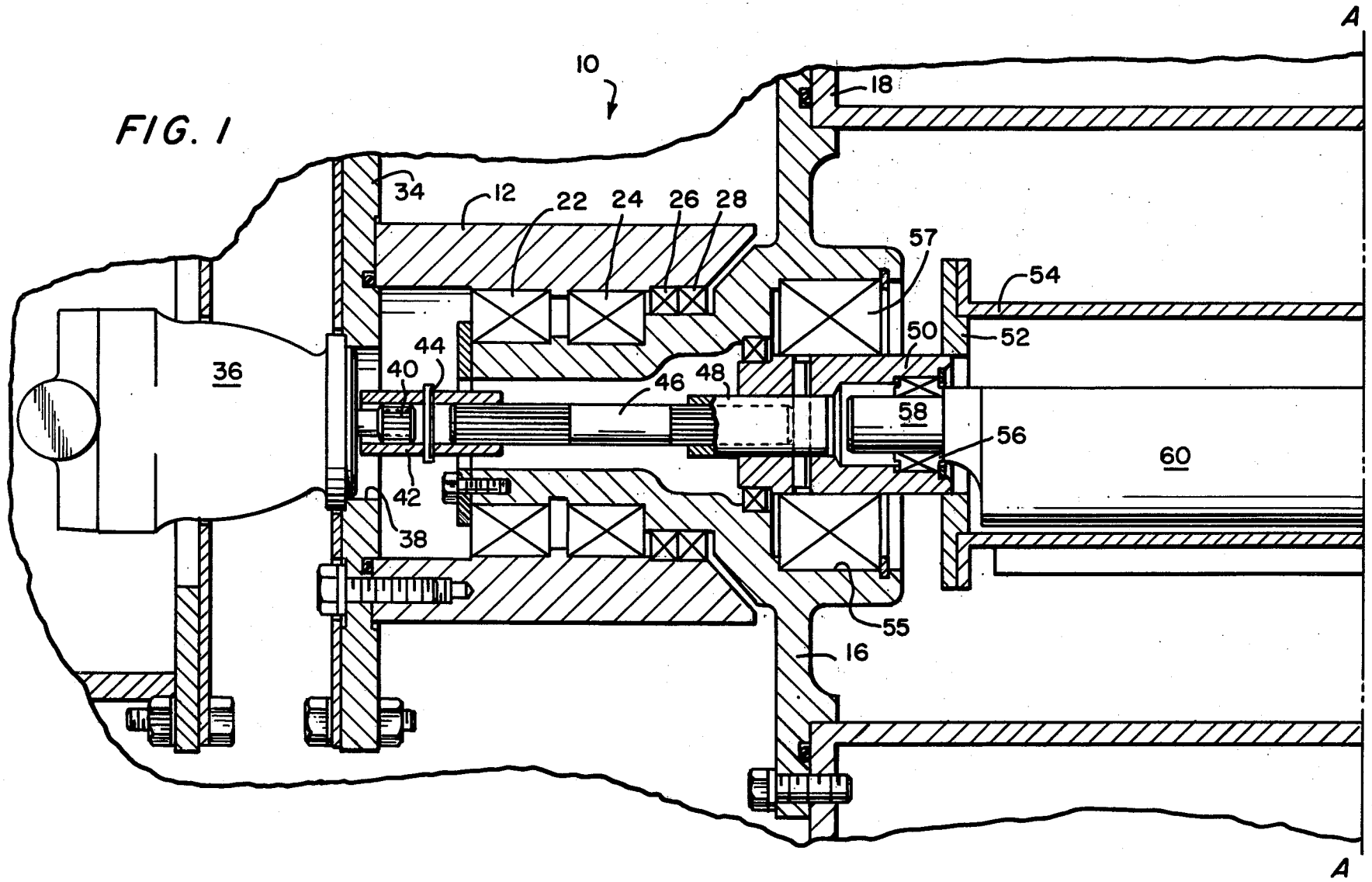
FIG. 1 is an axial cross-sectional view of an embodiment of the invention, the same comprising only the driven, axial end thereof.

As shown in the figures, the mechanism 10 comprises a first bearing and shaft end housing 12 axially spaced apart from a second bearing and shaft end housing 14. A spindle carrier (i.e., a drum support) 16 is journalled in the first end housing 12, and to the carrier 16 and housing 14 are bolted left-hand and right-hand support weldments 18 and 20 (for a compacting drum). Bearings 22 and 24, and seals 26 and 28 are operatively interposed between the housing 12 and the carrier 16, and a bearing 30 is operatively interposed between the housing 14 and a hollow stub shaft 32.

To the first end housing 12 is bolted a shock mounting plate 34. The shock mounting plate 34 is coupled to the frame of an earth comparator, or the like (by means not shown). A hydraulic motor 36 is mounted to the shock mounting plate, through an aperture 38, and the motor has a splined drive shaft 40 extending therefrom. A splined coupling 42 is slidably coupled thereto, and pinned in place by means of a roll pin 44. The coupling 42 slidably engages one end of a splined shaft 46. The other splined end of the shaft 46 is slidably engaged with another splined coupling 48 which is also pinned to another hollow stub shaft 50. The stub shaft 50 is welded to a vertical weldment 52 which, in turn, is bolted to an eccentrically-weighted tube 54. The carrier 16 has a cup-shaped recess 55 which receives a bearing 57 for journalling the stub shaft 50. The opposite end of the eccentrically-weighted tube 54 is bolted to a second housing weldment 52' which in turn is welded to the first-mentioned hollow stub shaft 32.

Both hollow stub shafts 50 and 32 journal the eccentrically-weighted tube 54 for rotation derived from motor 36. Within the hollow stub shafts 50 and 32 are fixed spherical bearings 56 which receive therein first and second solid stub shafts 58 and 58' of an adjustable, eccentrically-weighted shaft 60. The adjustable shaft 60 is therefore concentrically supported within the hollow, eccentrically-weighted tube 54 and is rotatably driven by the tube 54, by means of a keying and splining arrangement.

The second stub shaft 58' is of two parts 62 and 64. Part 62 is integral with shaft 60, and part 64 is pinned thereto (within bearing 56). Part 64 has an enlarged, splined land 66 intermediate the length thereof which slidably engages a similarly, internally splined, annular coupling 68. Externally thereof, coupling 68 has a groove 70 formed therein which nestably receives a key 72. Internally thereof, stub shaft 32 has an axially-extended keyway 74. The key 72, of course, slidably engages the keyway 74 and, thereby, transmits rotation of tube 54, weldment 52' and stub shaft 32 to the coupling 68. The latter, in turn, through the splined engagement thereof with the splined land 66, imparts rotation to part 64, 62, and shaft 60.

Land 66 is slidably disengageable from the coupling 68, however the two components are biased to maintain engagement. A compression spring 76 bears against an end of part 62 and the splined surface of coupling 68 to retain the land 66 and coupling 68 in driving/driven engagement. A handwheel 78 is keyed to the end of part 64 to facilitate an indexing of shaft 60 relative to tube 54.

Figure 1A:
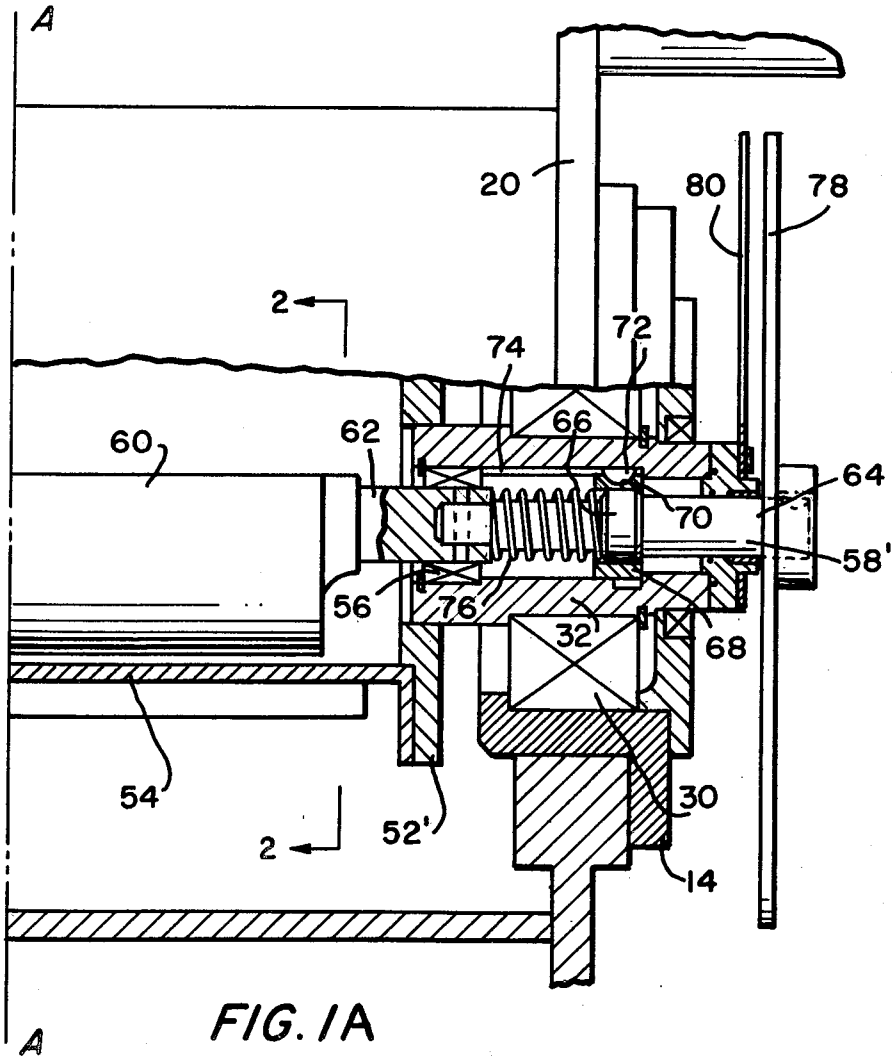
FIG. 1A is a view like that of FIG. 1, the same comprising a continuation of FIG. 1 and showing only the indexing-handwheel end of the mechanism.

As shown, the eccentric weights of both the tube 54 and the shaft 60 enclosed therewithin are radially aligned. Now, to displace the shaft 60, in order that its eccentric weight can be rotated relative to the eccentric weight of the tube 54, it is necessary only to pull the handwheel 78 axially to the right (as viewed in FIG. 1A) to disengage the splined land 66 from the splined coupling 68, rotate the handwheel through a desired arc, and allow it to return, under the urging of spring 76, to secure the selected, indexed positioning of shaft 60. Similar to the arrangement disclosed in the cited U.S. Pat. No. 4,152,943, the handwheel 78 has indicia (not shown) for degrees of arc. Such are rotated past an indicator 80 in order that the "phase" relationship between shaft 60 and tube 54 may be discerned and set.

Figure 2:
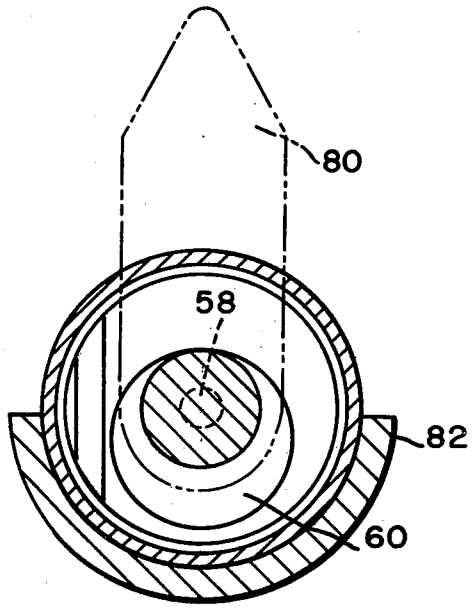
FIG. 2 is a cross-sectional view taken along section 2—2 of FIG. 1A; in this view, an end indicator is shown in phantom only to relate the indicator to the positionings of the eccentric elements.

As evidenced in FIG. 2, shaft 60 has eccentrically-offset shafts 58 and 58'. Tube 54, however, has centered shafts 32 and 50. It has, however, a semi-circular or half-shell weight 82 welded thereto.

By having the weighted eccentricities radially aligned, there will be induced a maximum vibration, and by indexing the shaft 60 to where its eccentric weight is 180 degrees out of phase with weight 82, vibration is at a minimum. As desired, settings therebetween can be made by use of the handwheel 78, as has been explained.

While we have described our invention in connection with a specific embodiment thereof, it is to be clearly understood that this is done only by way of example, and not as a limitation to the scope of our invention as set forth in the objects thereof and in the appended claims.

We claim:

1. A vibratory mechanism, especially for use with an earth-compacting drum, comprising:

a plurality of elongate elements having eccentrically-weighted, radially-disposed portions;

means supporting said elements for rotation about a common axis, with said portions in a first positioning wherein said portions are in common radial alignment therebetween, and in diverse, non-radially-aligned dispositions therebetween; and means coupled to said elements for rotating the latter, in unison, about said axis; wherein said supporting and rotating means comprise means for adjustably orienting one of said elements, relative to the other thereof, from one of said first and second positionings to the other thereof;

said orienting means comprises means for (a) moving said one element in a first axial direction, (b) rotatably indexing said one element from said one positioning to said other positioning, (c) moving said one element in a second, opposite axial direction, and (d) displacably securing said one element in said other positioning;

said one element is confined within said other element; and said rotating means comprises a motor drivingly coupled to said other element.

2. A vibratory mechanism, according to claim 1, wherein:

one of said elements is rotatably journalled in the other of said elements.

3. A vibratory mechanism, according to claim 2, wherein:

said other element has hollow, first stub shafts at opposite ends thereof; and said one element has second stub shafts journalled in said first stub shafts.

4. A vibratory mechanism, according to claim 1, wherein:

said rotating means comprises means defining a driving coupling between said one and other element.

5. A vibratory mechanism, according to claim 4, wherein:

said driving-coupling means comprises (a) a hollow stub shaft fixed to one end of said other element, (b) a keyway formed in said stub shaft, and (c) keying means coupled to said one element and in driven engagement with said keyway.

6. A vibratory mechanism, according to claim 5, wherein:

a first portion of said keying means is slidably disengageable from another portion thereof to accommodate an axial translation of said one element.

7. A vibratory mechanism, according to claim 6, further including:

means interposed between said one element and said keying means biasing said keying means into driven engagement with said keyway.

8. A vibratory mechanism, according to claim 5, wherein:

said one element also has a solid stub shaft at one end thereof; and said keying means comprises (a) splining formed in said solid stub shaft (b) an annulus interposed between said splining and said hollow stub shaft, said annulus having (1) splining formed therein, on a first peripheral surface thereof, slidably engaged with said solid stub shaft splining, and (2) a groove formed in a second peripheral surface thereof, and (c) a key engaged with said groove and said keyway.

9. A vibratory mechanism, according to claim 8, further including:

an indexing handwheel fixed to an end of said solid stub shaft.

10. A vibratory mechanism, according to claim 3, further including:

spherical bearings interposed between said first and second stub shafts; and said one element is axially slidably supported in said bearings.

11. A vibratory mechanism, according to claim 2, wherein:

said rotating means includes a motor drivingly coupled to one of said first and second stub shafts.

* * * * *

UNITED STATES PATENT AND TRADEMARK OFFICE

CERTIFICATE OF CORRECTION

PATENT NO. : 4,454,780

DATED : Jun. 19, 1984

INVENTOR(S) : Robert F. Goehler, et al

It is certified that error appears in the above—identified patent and that said Letters Patent is hereby corrected as shown below:

Column 3, line 29 (Claim 1, line 8), before "in diverse", insert: --second positionings wherein said portions are--;

Column 3, line 35 (Claim 1, line 14), change "from one of said first and" to --from said first positioning to a--;

Column 3, line 36 (Claim 1, line 15), change to read: --selected one of said second positionings;--;

Column 3, line 39 (Claim 1, line 18), change "one posi-" to --first posi- --;

Column 3, line 40 (Claim 1, line 19), change "other positioning" to --selected one of said second positionings--;

Column 3, line 42 (Claim 1, line 21), correct the spelling of "displacably" to --displaceably--; and Column 3, line 43 (Claim 1, line 22), change "other positioning" to --selected one of said second positionings--.

Signed and Sealed this

Twenty-fourth Day of March, 1987

*Attest:*

DONALD J. QUIGG

*Attesting Officer*

*Commissioner of Patents and Trademarks*